US012049803B1

(12) United States Patent
Rogozinski et al.

(10) Patent No.: US 12,049,803 B1
(45) Date of Patent: Jul. 30, 2024

(54) AUTOFILL CONVERSION ASSEMBLY WITH AN INTERCHANGEABLE FLOW PORT BALL CAGE AND METHOD OF USE

(71) Applicant: Citadel Casing Solutions LLC, Houston, TX (US)

(72) Inventors: Nicolas Rogozinski, Evergreen, CO (US); Henry Eugene Rogers, Owasso, OK (US)

( * ) Notice: Subject to any disclaimer, the term of this patent is extended or adjusted under 35 U.S.C. 154(b) by 0 days.

(21) Appl. No.: 18/476,430

(22) Filed: Sep. 28, 2023

(51) Int. Cl.
*E21B 34/14* (2006.01)
*E21B 34/10* (2006.01)

(52) U.S. Cl.
CPC ..... *E21B 34/14* (2013.01); *E21B 34/10* (2013.01); *E21B 2200/04* (2020.05); *E21B 2200/05* (2020.05)

(58) Field of Classification Search
CPC ..... E21B 2200/04; E21B 2200/05; E21B 2200/06; E21B 34/10; E21B 34/14
See application file for complete search history.

(56) References Cited

U.S. PATENT DOCUMENTS

| | | | | |
|---|---|---|---|---|
| 4,729,432 | A * | 3/1988 | Helms | E21B 34/14 166/317 |
| 6,401,824 | B1 | 6/2002 | Musselwhite et al. | |
| 6,684,957 | B2 | 2/2004 | Allamon | |
| 2011/0290344 | A1* | 12/2011 | Groesbeck | E21B 34/16 137/430 |
| 2017/0175487 | A1* | 6/2017 | Marcin | E21B 34/14 |
| 2018/0112493 | A1* | 4/2018 | Recchioni | E21B 34/10 |
| 2019/0093454 | A1* | 3/2019 | Styler | E21B 34/142 |

* cited by examiner

*Primary Examiner* — Christopher J Sebesta
(74) *Attorney, Agent, or Firm* — Avek IP, LLC

(57) ABSTRACT

A combination of an autofill tube and an interchangeable ball cage for use in an autofill conversion assembly during well operations includes the tube extending to a downhole opening, the tube has a mounting mechanism to releasably mount the tube within an outer member; the interchangeable ball cage having a main body forming a bore; a downhole opening; circulation ports; and an attachment mechanism removably connecting the main body to the autofill tube; the downhole opening has a diameter selected to prevent a conversion ball from falling therethrough; the circulation ports provide fluid flow through the interchangeable ball cage such that the circulation ports have a number and size to create a preset maximum flowrate associated with the combination of the autofill tube and the interchangeable ball cage; and the interchangeable ball cage is to be selected based on the preset maximum flowrate desired at a well site.

15 Claims, 8 Drawing Sheets

AUTOFILL CONVERSION ASSEMBLY WITH AN INTERCHANGEABLE FLOW PORT BALL CAGE AND METHOD OF USE

FIELD OF THE DISCLOSURE

The disclosure relates generally to wellbore systems. More specifically, the disclosure relates to an interchangeable flow port ball cage for an autofill conversion assembly and method of use in which the flow port ball cage is selectively interchangeable as needed by an operations team allowing for customization of a fluid bypass mechanism at a wellsite.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to an autofill conversion assembly for use in well drilling operations, the autofill conversion assembly comprising an outer member mounted within a pipe and a ball cage positioned substantially adjacent to the outer member and having one or more fluid flow openings. An autofill tube secured within the outer member and having a downhole end. One or more tension mounted valves positioned such that an outer wall of the autofill tube holds the one or more tension mounted valves in open positions. An interchangeable ball cage removably secured to the downhole end of the autofill tube, the interchangeable ball cage having one or more circulation ports, a bore extending a length of the ball cage, and a downhole opening having a diameter less than a diameter of the bore. A fluid flow passage extending through the pipe and the outer member. A conversion ball having a diameter greater than the diameter of the downhill opening. Wherein the autofill conversion assembly includes at least a run-in hole configuration wherein the conversion ball is positioned within the ball cage, the ball cage allowing for fluid to flow therethrough. Wherein the conversion ball is configured to release from the ball cage and travel through the autofill tube to engage with the interchangeable ball cage. Wherein an application of a predetermined pressure from fluid flow through the autofill tube to the conversion ball causes a release of the autofill tube from the outer member. Wherein the release of the autofill tube from the outer member releases the one or more tension mounted valves such that the one or more tension mounted valves close the outer member and therefore close the fluid flow passage.

In other aspects, the present invention relates to a combination of an autofill tube and an interchangeable ball cage for use in an autofill conversion assembly as part of well drilling operations. The combination includes the autofill tube extending from a first end to a downhole end, the autofill tube has a mounting mechanism configured to releasably mount the autofill tube within an outer member. The interchangeable ball cage having a main body forming a bore extending therethrough, a downhole opening, one or more circulation ports extending through the main body, and an attachment mechanism removably connecting the main body to the autofill tube. The downhole opening has a diameter selected to prevent a conversion ball from falling therethrough. Wherein the one or more circulation ports provide fluid flow through the interchangeable ball cage such that the one or more circulation ports have a number and size to create a preset maximum flowrate associated with the combination of the autofill tube and the interchangeable ball cage. The interchangeable ball cage is configured to be selected based on the preset maximum flowrate desired at a well site based on well parameters.

In other aspects, the present invention relates to a method of selecting a maximum flowrate for an autofill conversion assembly for use in well drilling operations, the method comprising providing the autofill conversion assembly having an outer member configured to be mounted within a pipe, a ball cage positioned substantially adjacent to the outer member and having one or more fluid flow openings, an autofill tube secured within the outer member and having a downhole end, one or more tension mounted valves positioned such that an outer wall of the autofill tube holds the one or more tension mounted valves in open positions, and a conversion ball having a starting position within the ball cage. Further providing a plurality of interchangeable ball cages, each of the interchangeable ball cages having a main body forming a bore extending a length of the main body to a downhole opening, the downhole opening having a diameter less than a diameter of the conversion ball, and one or more circulation ports extending through a thickness of the main body, wherein the one or more circulation ports create an associated maximum flowrate of an associated one of the plurality of interchangeable ball cages such that a first of the plurality of interchangeable ball cages has a first maximum flowrate that differs from a second maximum flowrate of a second of the plurality of interchangeable ball cages. Selecting one of the plurality of interchangeable ball cages based on the associated maximum flowrate. Attaching the selected one of the plurality of interchangeable ball cages to the autofill tube to complete the autofill conversion assembly. Launching the autofill conversion assembly with a casing and using the autofill conversion assembly for one or more well operations.

BRIEF DESCRIPTION OF THE SEVERAL VIEWS OF THE DRAWINGS

Illustrative embodiments of the present disclosure are described in detail below with reference to the attached drawing figures.

Figure 1:
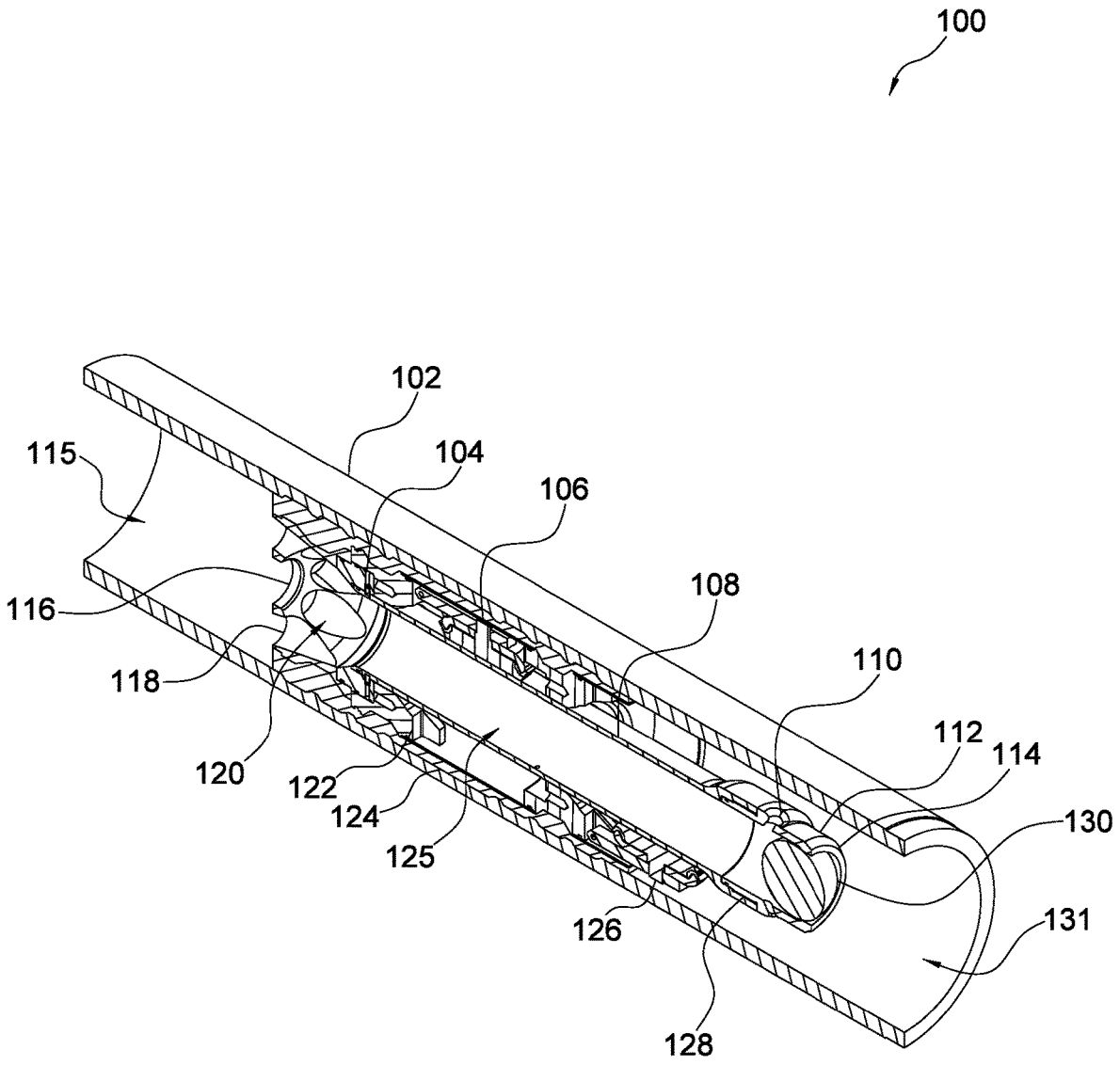
FIG. 1 is an angled, cross-sectional view of an autofill conversion assembly having an interchangeable flow port ball cage in accordance with the present invention.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. During many well drilling operations, a casing is run into a borehole and set in place generally through cement operations, wherein cement is pushed into the annulus between the casing and the interior wall of the borehole. In some running operations, float collars are utilized to improve efficiency during casing running by providing an assembly wherein a float collar is initially in an open configuration, such that drilling fluid can flow freely through the float collar as the casing is being run downhole. Once the casing is run to a total depth, the float collar may be converted to a closed configuration, such that the flow path is closed via one or more valves, the one or more valves configured to create a predetermined level of resistance within the casing such that only fluid flow that has a force great enough to overcome the predetermined level of resistance will flow therethrough. In other words, during cementing operations, cement may be pumped through the closed configuration of the float collar by overcoming the resistance of the valve(s) such that the valve(s) then prevent backflow through the assembly. Once cementing operations are completed, the float collar assembly can be drilled out such that the flow path is unobstructed for pumping operations.

Prior designs of autofill conversion assemblies discussed above have provided for selectable flowrate options by having manufactured assemblies with circulation ports varying in number and size such that a threshold surface applied pressure is conditionally achieved through increasing a flowrate of fluid, fluid selection, or other well parameters. The circulation ports being manufactured into the assembly, such that the decision for said well parameters is determined during manufacturing of the assembly.

The present invention provides for an interchangeable flow port ball cage that provides for a selective maximum flowrate a well site. In other words, the present invention includes the interchangeable flow port ball cage that is removable and replaceable from an autofill tube such that the operator, at a well site, can select one of a plurality of interchangeable flow port ball cages based on well site parameters, flowrate, and fluid properties. The selection of interchangeable flow port ball cages will include cages that have various levels of resistance, and therefore have maximum flowrates. This eliminates the requirement that an operator is confined to a manufactured assembly, and instead, can make decisions based on a particular well site as needed.

FIG. 1 shows an autofill conversion assembly 100 for use in well drilling operations in accordance with the present invention. The assembly 100 includes an outer member 122 mounted within a pipe 102 through an attachment means 124. The attachment means, in embodiments, is cement, however, it should be appreciated that embodiments may vary. A ball cage 118 with an initial ball seat 116 is positioned substantially adjacent to the outer member 122 and has one or more fluid flow openings 120. Those skilled in the art will appreciate that the ball cage 118 provides an initial holding position for a conversion ball 130 while still allowing fluid to flow through the assembly. Further, the ball cage 118 may vary based on design or manufacturing considerations understood by those skilled in the art. The components of the assembly 100 may vary in materials, such as metals, plastics, or other suitable materials.

An autofill tube 108 is secured within the outer member 122 and extends from a first end to a downhole end 131. The autofill tube 108 may again vary in dimensions as would be understood by those skilled in the art, but at least includes a central channel 125 to allow fluid to flow therethrough. The autofill tube 108 is releasably secured to the outer member 122 such that upon receiving a predetermined pressure, the autofill tube 108 will release from the outer member 122. One contemplated attachment mechanism is one or more shear pins 104 that are well known in the art to create a pressure release mechanism.

The assembly 100 further includes one or more tension mounted valves 106, 126 that are held in an open position by the autofill tube 108 as shown in FIG. 1. In embodiments, the one or more tension mounted valves are a first flapper valve 106 and a second flapper valve 126. As will be discussed in more detail herein, the tension mounted valves 106, 126 are configured to close a flow passage 115 after the autofill tube 108 is released from the outer member 122.

The assembly 100 further includes an interchangeable ball cage 112 that is removably secured to the downhole end 131 of the autofill tube 108. The use of an interchangeable ball cage 112 is considered unique to the present invention and provides for benefits not currently found in the art. Specifically, the interchangeable ball cage 112 has one or more circulation ports 110. These circulation ports 110 can vary in size and number such that the resistance to fluid flow therethrough changes based on a selected interchangeable ball cage 112. In other words, larger (in size and/or number) circulation ports 110 create less resistance to fluid flow. This allows for the operator to select a desired maximum flowrate allowed by the interchangeable ball cage 112 before the ball cage 112 itself, along with the autofill tube 108 receive increasing pressure. This increase in pressure will eventually cause the autofill tube 108 to release via the shear pins 104. This feature allows for an operator or operations team to select a ball cage 112 that is suitable for a particular well site based on fluid properties, well parameters, and flowrates.

The interchangeable ball cage 112 is unique in the art by including an attachment mechanism 128 such that the cage 112 can be removed and replaced from the autofill tube 108. Or in other words, an operator can select a cage 112 based on a particular wellsite to add to the assembly 100 at a well site, as opposed to selecting a fully manufactured assembly. The maximum flowrate may vary based on fluid properties, however, this again allows the operator flexibility to achieve a desired pressure drop of the autofill tube 108 by correlating the fluid properties and flowrate. The attachment mechanism 128 may vary, however, in embodiments is a threaded connection between the ball cage 112 and the autofill tube 108, and more specifically includes exterior threads on the ball cage 112 to engage with interior threads on the autofill tube 108.

Figure 7A:
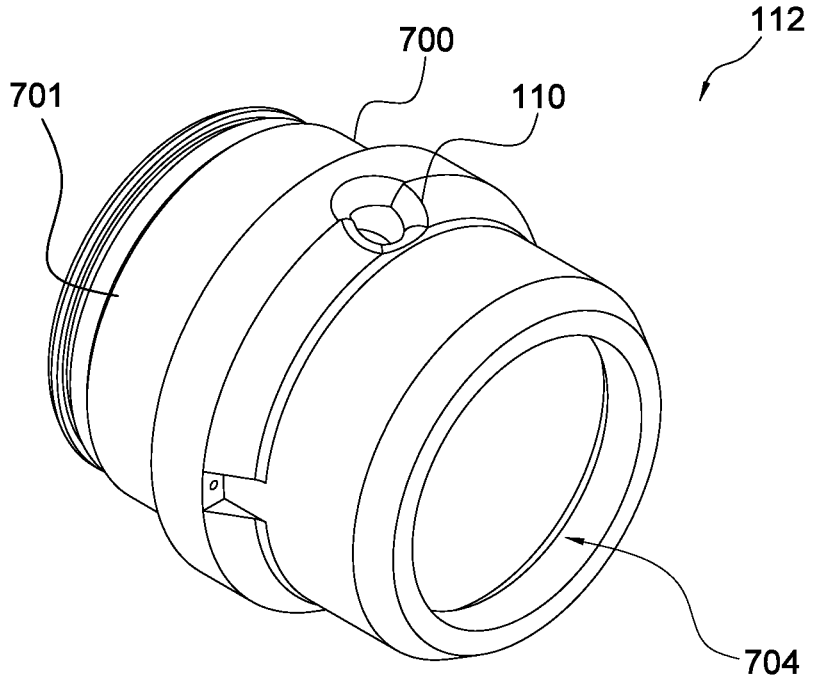
FIG. 7A is an angled view of an exemplary embodiment of the interchangeable ball cage as part of the autofill conversion assembly of the present invention.
Figure 7B:
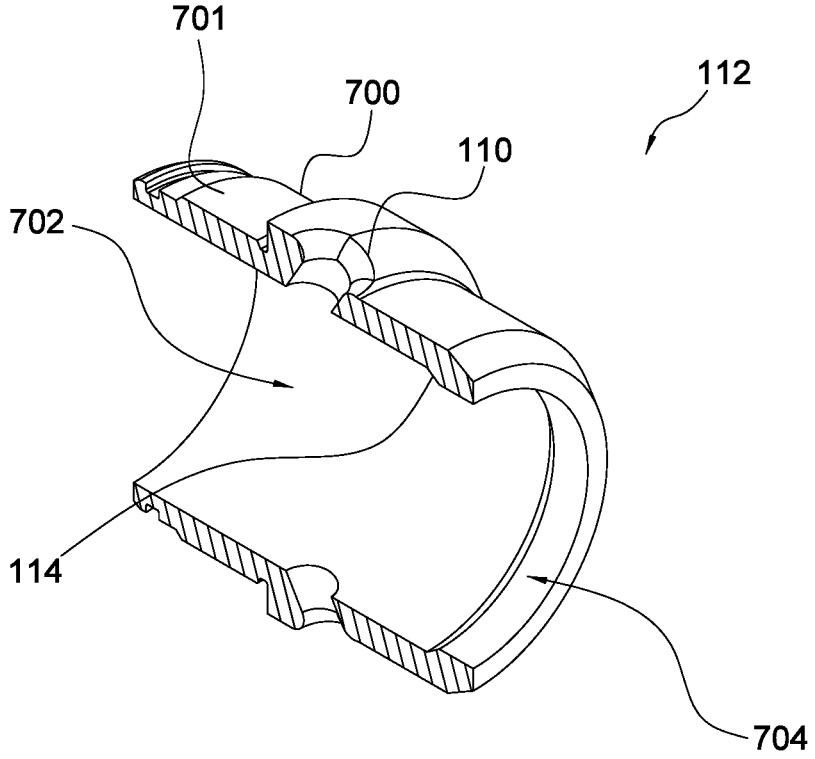
FIG. 7B is an angled, cross-sectional view of the exemplary embodiment of the interchangeable ball cage as part of the autofill conversion assembly of the present invention.

As best shown in FIGS. 7A and 7B, the interchangeable ball cage 112 includes a main body 700 forming a bore 702 extending a length of the ball cage 112. A downhole opening 704 is at the bottom end and has a diameter less than a diameter of the bore 702. In other words, the bore 702 is large enough that the conversion ball 130 will travel therethrough, while the opening 704 is small enough to prevent the conversion ball 130 from exiting the interchangeable ball cage 112. In embodiments, a shoulder 114 extends into an interior of the main body 700 to reduce the opening 704 and prevent the ball 130 from exiting. Further shown is an example of exterior threads 701 as part of the attachment mechanism 128.

Figure 2:
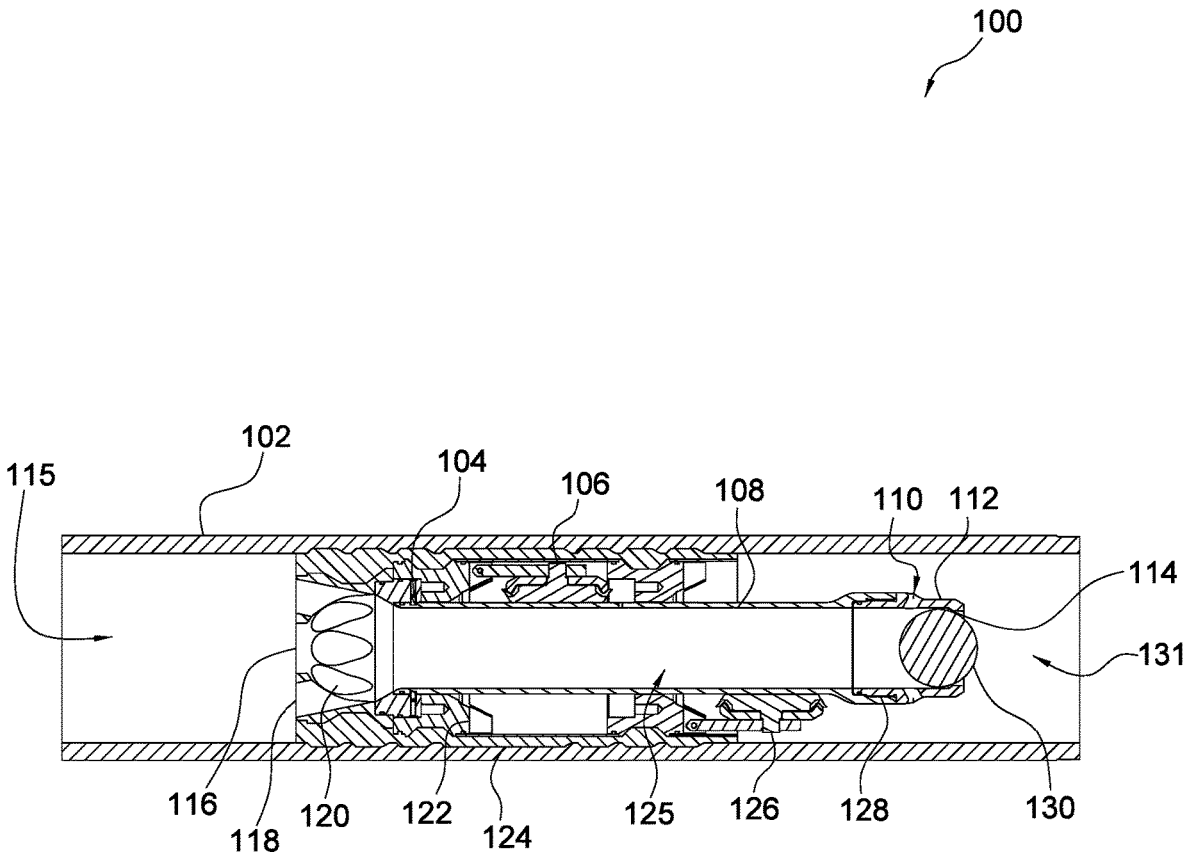
FIG. 2 is a side, cross-sectional view of the autofill conversion assembly in an assembled configuration allowing for fluid circulation from up-hole to down-hole.
Figure 3:
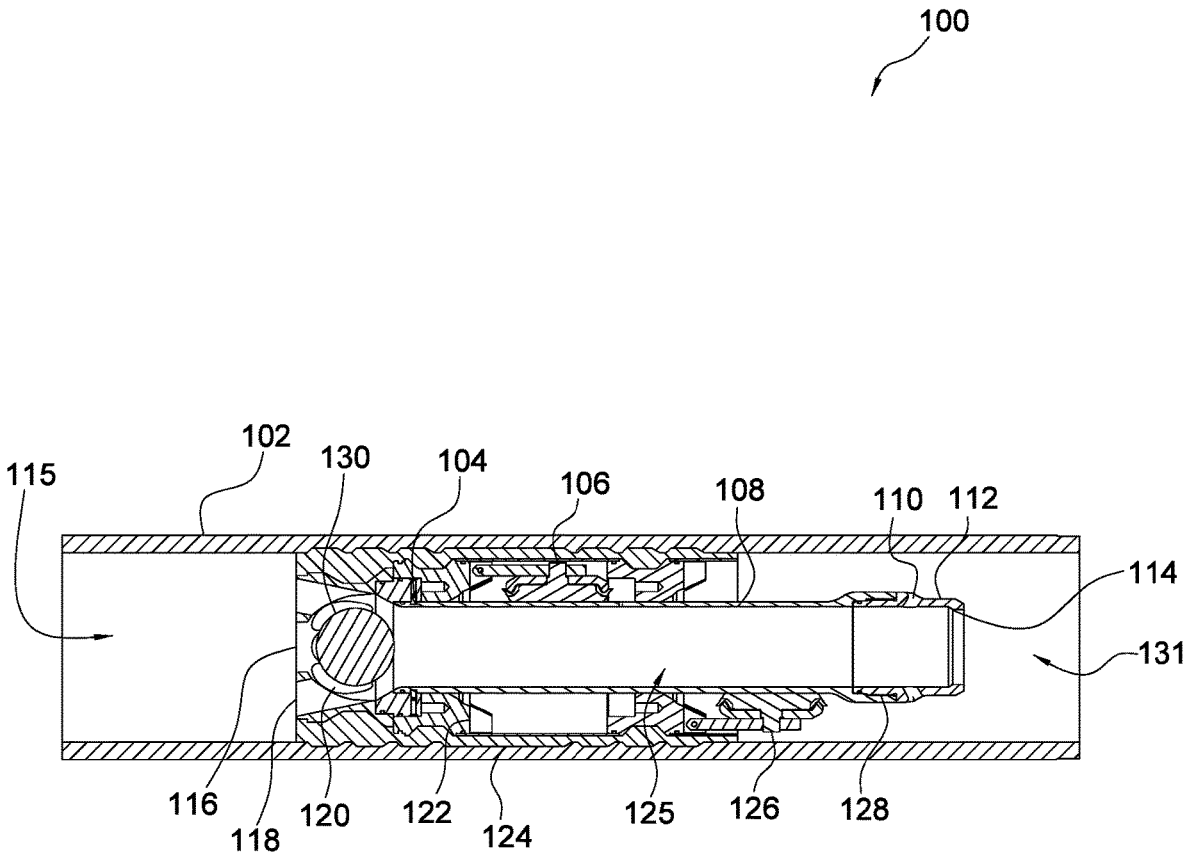
FIG. 3 is a side, cross-sectional view of the autofill conversion assembly in a run-in hole configuration.

Referring back now to FIGS. 2 through 6, the assembly 100 is shown in a series of operational views. FIG. 2 depicts the assembly 100 in an assembled configuration wherein fluid circulation is allowed from up hole to down hole (left to right). FIG. 3, on the other hand, demonstrates the assembly 100 in the run-in hole configuration, wherein the fluid is permitted to enter the assembly from down hole to up hole (right to left).

Figure 4:
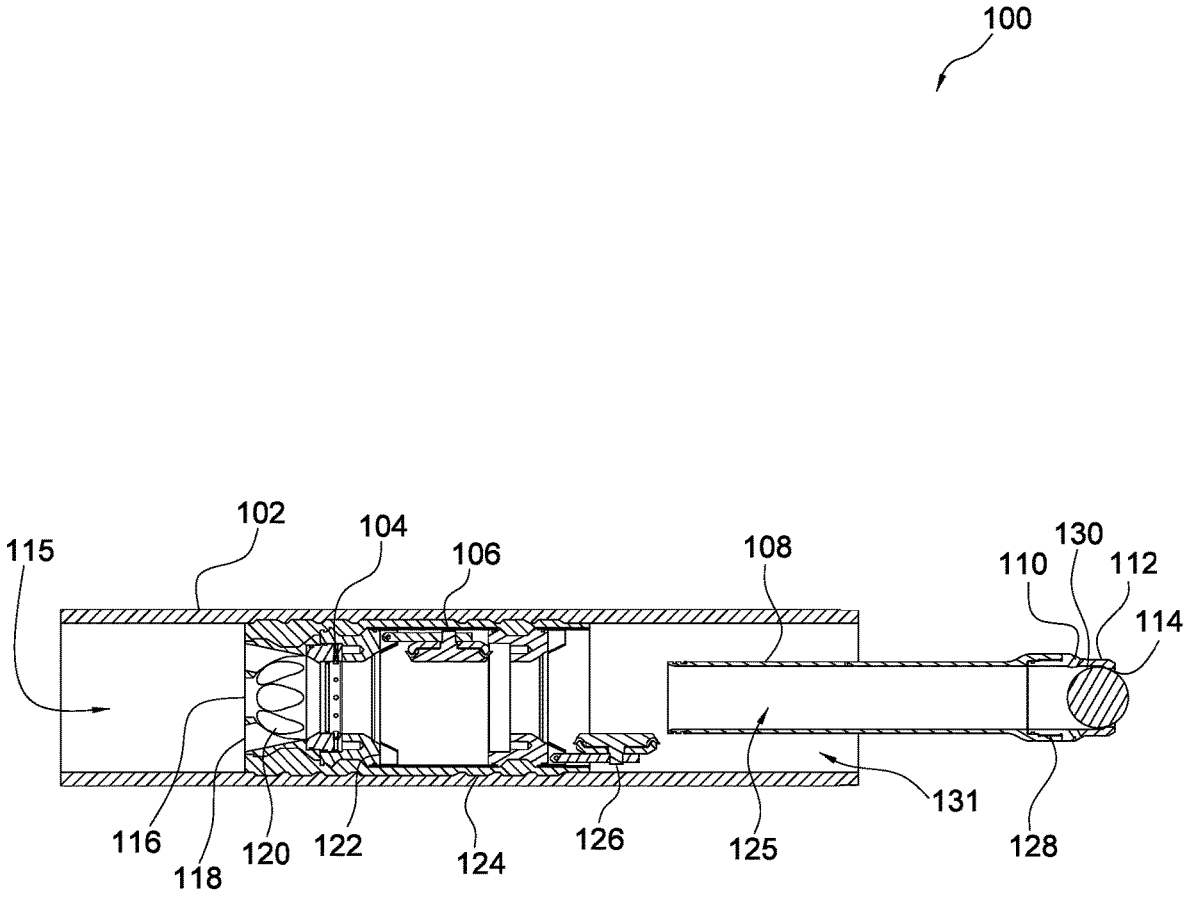
FIG. 4 is a side, cross-sectional view of the autofill conversion assembly showing an autofill tube as released from the assembly and traveling downhole.

The assembly 100 as shown in FIG. 3, with the conversion ball 130 initially held in the ball cage 118 is run in hole with the pipe 102 and the autofill tube 108 initially secured to the outer member 122 via shear pin(s) 104. Once the assembly is run in hole to a depth below the ground surface, surface originating pressure may be applied such that the conversion ball 130 releases, travels through the autofill tube 108, and lands in the interchangeable ball cage 112. Eventually, as pressure increases, the autofill tube 108 and the interchangeable ball cage 112 release from the outer member 122 and travel downhole, as shown in FIG. 4. The required pressure depends on the selected interchangeable ball cage 112 having circulation ports 110 that are selected in size and number to restrict fluid flow and allow an operator to control a pressure drop based on fluid properties.

Figure 5:
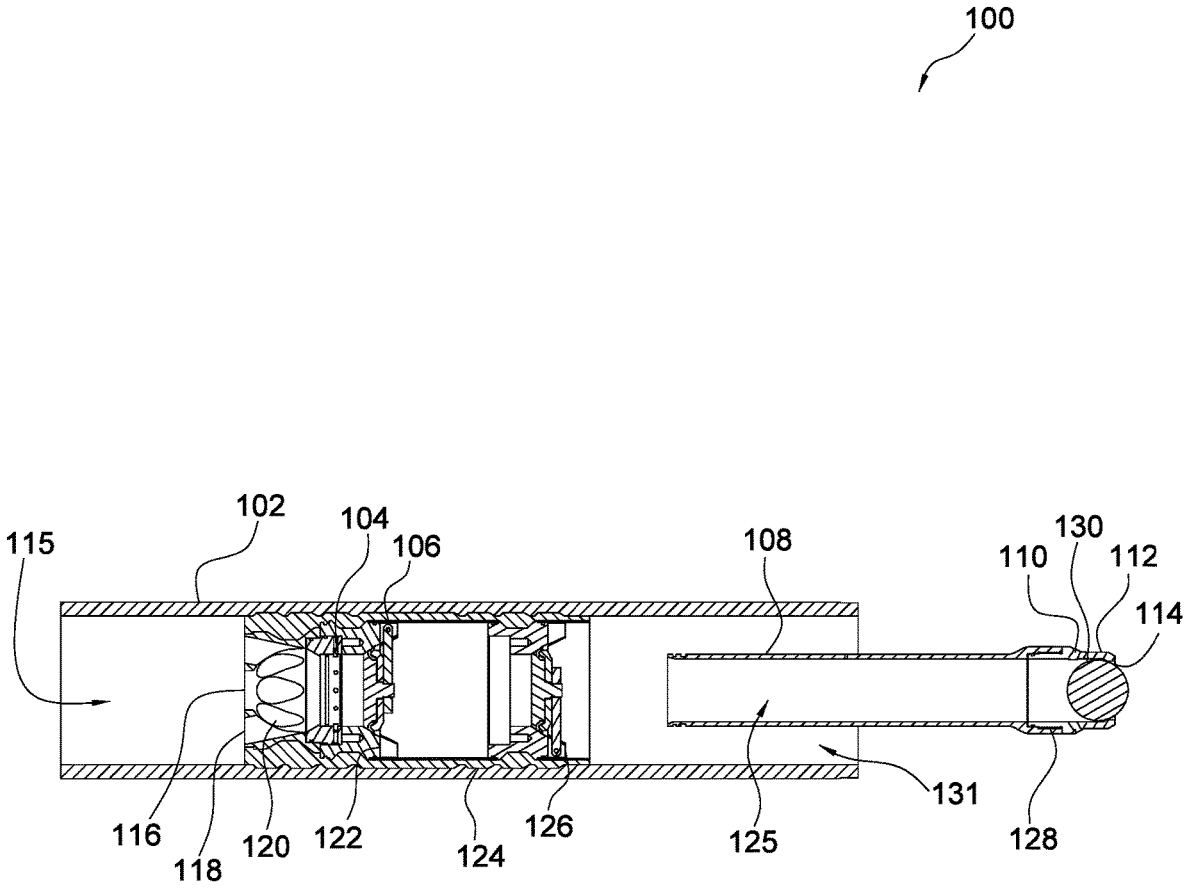
FIG. 5 is a side, cross-sectional view of the autofill conversion assembly showing the autofill tube as released and first and second spring loaded flapper valves in closed positions.
Figure 6:
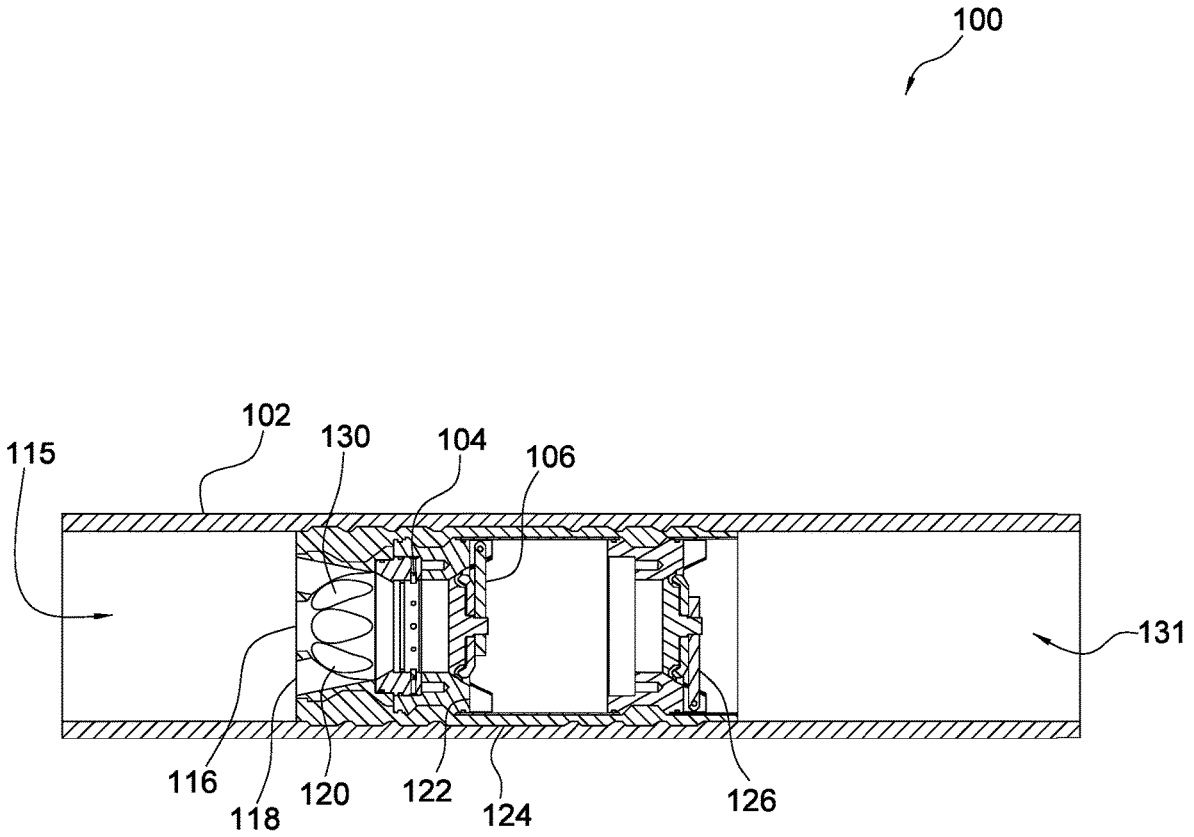
FIG. 6 is a side, cross-sectional view of the autofill conversion assembly in an end of job configuration showing the first and second spring loaded flapper valves in the closed positions.

After the autofill tube 108 and interchangeable ball cage 112 release and travel downhole, the tension mounted valves 106, 126 close the flow path 115 such that the tension mounted valves only allow fluid flow to occur from up hole to downhole, as shown best in FIG. 5. In FIG. 6, the assembly 100 is shown in an end of job configuration, with the autofill tube 108 and interchangeable ball cage 112 released. As needed, the assembly 100 may be drilled out during well operations.

Again, as discussed above, one of the unique features believed characteristic of the present invention is the use of an interchangeable ball cage 112 such that an operator may select a desired cage 112 at a well site, post manufacturing of the assembly 100, but prior to installation within the pipe. This specifically allows for the operator to implement reliable autofill that incorporates the option to vary the flow port size of the ball cage 112 based on wellsite parameters such as fluid density and flowrate. These novel features provide for improved reliable autofill capabilities under various demanding well operations.

Figure 8:
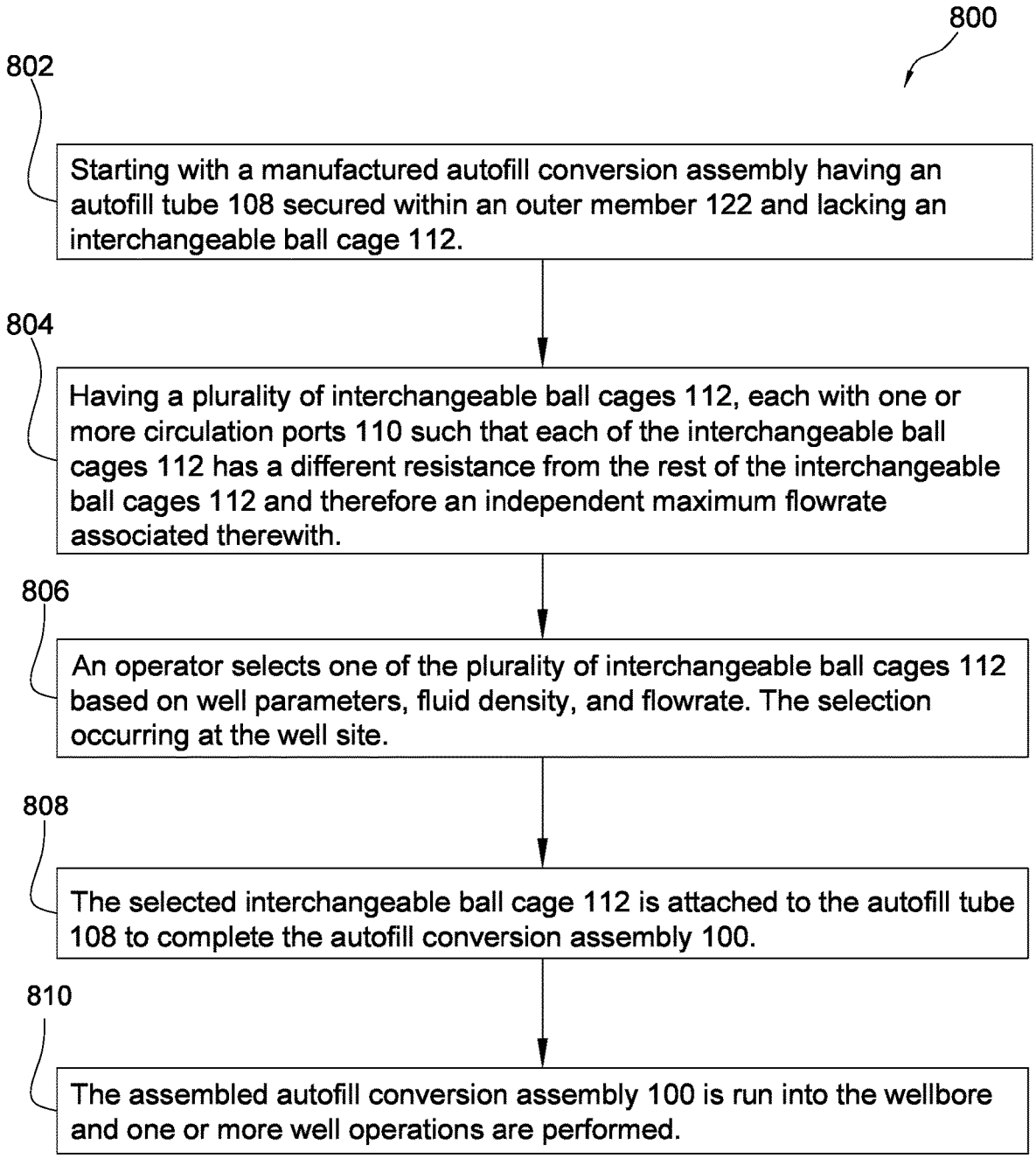
FIG. 8 is a flowchart of a method of use of the autofill conversion assembly of the present assembly.

FIG. 8 is a flowchart 800 that summarizes a method of selecting a maximum flowrate as determined by an interchangeable ball cage 112 for the autofill conversion assembly 100 for use in a well drilling operation. At step 802, an operator or operations team at a well site will start with a manufactured autofill conversion assembly having the autofill tube 108 mounted within the outer member 122 and other necessary components, but specifically lacking a ball cage 112. At step 804, the operator or operations team will have access to a plurality of interchangeable ball cages 112 each one having specifically designed circulation ports 110 that create a unique fluid flow resistance associated with the particular cage. In other words, each interchangeable ball cage will have a maximum allowable flowrate based on the circulation ports 110.

At step 806, an operator or operations team can select one of the plurality of interchangeable ball cages 112 based on well parameters, fluid density, and flowrate. This selection being done at the well site. At step 808, once the selection is made, the selected interchangeable ball cage 112 is attached to the autofill tube 108 to complete the autofill conversion assembly 100. The connection of the selected interchangeable ball cage 112 may be achieved through any means known in the art, however, in at least some embodiments, a threaded connection is used. At step 810, the fully assembled autofill conversion assembly 100 is run into the wellbore such that it can be utilized during one or more well operations. The well operations may vary as would be understood by those skilled in the art.

The use of interchangeable ball cages 112 allows for a decision on the needed cage to be pushed to the well site as opposed to during a manufacturing stage. This allows for the operator or operations team to take the particular well site parameters into account while making the selection.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. An autofill conversion assembly for use in a well drilling operation, the autofill conversion assembly comprising:

an outer member mounted within a pipe;

a ball cage positioned substantially adjacent to the outer member and having one or more fluid flow openings;

an autofill tube secured within the outer member and having an upper end and a downhole end, the ball cage positioned at the upper end;

one or more tension mounted valves positioned such that an outer wall of the autofill tube holds the one or more tension mounted valves in open positions;

an interchangeable ball cage removably secured to the downhole end of the autofill tube, the interchangeable ball cage extending from a top end to a bottom end, the top end being removably secured to the autofill tube via an attachment mechanism and the bottom end forming a downhole opening, the interchangeable ball cage having one or more circulation ports; and a conversion ball initially held within the ball cage and configured to release from the ball cage and travel to the downhole opening of the interchangeable ball cage and block the downhole opening from fluid flow, the conversion ball does not block the one or more circulation ports after traveling to the downhole opening.

2. The assembly of claim 1, wherein the one or more circulation ports of the interchangeable ball cage create selective resistance to fluid flow for the interchangeable ball cage such that the interchangeable ball cage is selected based on a desired resistance to fluid flow.

3. The assembly of claim 1, further comprising:

wherein the autofill conversion assembly includes at least a run-in hole configuration wherein the conversion ball is positioned within the ball cage, the ball cage allowing for fluid to flow therethrough;

wherein the conversion ball is configured to release from the ball cage and travel through the autofill tube to engage with the interchangeable ball cage at the downhole end;

wherein an application of a predetermined pressure from fluid flow through the autofill tube to the conversion ball causes a release of the autofill tube from the outer member, the predetermined pressure determined based on parameters of the one or more circulation ports, the one or more circulation ports allowing fluid to flow therethrough; and wherein the release of the autofill tube from the outer member releases the one or more tension mounted valves such that the one or more tension mounted valves close the outer member and therefore close the fluid flow passage.

4. The assembly of claim 1, wherein the interchangeable ball cage further comprises:

a main body forming a bore;

a shoulder extending inward into the main body near the downhole opening, the shoulder forming a diameter less than a diameter of the conversion ball such that the conversion ball is unable to pass therethrough; and the one or more circulation ports extending through the body, the one or more circulation ports being selectable in size and number to establish a preset maximum flowrate that corresponds to a predetermined pressure.

5. The assembly of claim 1, wherein the attachment mechanism comprises exterior threads on the main body to engage with interior threads on the autofill tube.

6. The assembly of claim 1, wherein the autofill tube is secured within the outer member via one or more pins, the one or more pins configured to release the autofill tube upon application of a predetermined pressure.

7. The assembly of claim 1, wherein the one or more tension mounted valves comprise:

a first spring loaded flapper valve; and a second spring loaded flapper valve;

wherein each of the first and second spring loaded flapper valves are held in a contracted position by the autofill tube and released from the contract position upon release of the autofill tube.

8. A combination of an autofill tube and an interchangeable ball cage for use in an autofill conversion assembly as part of a well drilling operation, the combination comprising:

the autofill tube extending from a first end to a downhole opening, the autofill tube has a mounting mechanism configured to releasably mount the autofill tube within an outer member of the autofill conversion assembly; and the interchangeable ball cage having an attachment mechanism removably connecting the interchangeable ball cage to the autofill tube, the interchangeable ball cage extending from a top end to a bottom end, the top end being removably secured to the autofill tube via an attachment mechanism and the bottom end forming a downhole opening, the interchangeable ball cage having one or more circulation ports;

wherein the interchangeable ball cage is configured to be selected based on one or more well parameters; and wherein the interchangeable ball cage is configured to receive a conversion ball during well operations such that the conversion ball blocks the downhole opening from fluid flow and the conversion ball does not block the one or more circulation ports after traveling to the downhole opening.

9. The combination of claim 8, wherein the interchangeable ball cage further comprises:

a main body forming a bore extending therethrough and to the downhole opening; and wherein the downhole opening has a diameter selected to prevent the conversion ball from falling therethrough;

wherein the one or more circulation ports provide fluid flow through the interchangeable ball cage such that the one or more circulation ports have a number and size to create a preset maximum flowrate associated with the combination of the autofill tube and the interchangeable ball cage; and wherein the interchangeable ball cage is configured to be selected based on the preset maximum flowrate desired at a well site.

10. The combination of claim 8, wherein the mounting mechanism comprises one or more shear pins, wherein the one or more shear pins are configured to withstand a predetermined pressure such that as fluid is forced through the autofill tube and increases pressure applied to the interchangeable ball cage as permitted by a preset maximum flowrate, the increase in pressure causes a release of the mounting mechanism once the predetermined pressure is reached.

11. The combination of claim 8, wherein the attachment mechanism comprises exterior threads on a main body to engage with interior threads on the autofill tube.

12. The combination of claim 8, wherein the interchangeable ball cage further comprises a shoulder extending inwardly to create a diameter selected to prevent the conversion ball from falling therethrough.

13. A method of selecting a maximum flowrate for an autofill conversion assembly for use in a well drilling operation, the method comprising:

providing the autofill conversion assembly having an outer member configured to be mounted within a pipe, a ball cage positioned substantially adjacent to the outer member and having one or more fluid flow openings, an autofill tube secured within the outer member and having a downhole end, one or more tension mounted valves positioned such that an outer wall of the autofill tube holds the one or more tension mounted valves in open positions, and a conversion ball having a starting position within the ball cage;

providing a plurality of interchangeable ball cages, each of the interchangeable ball cages having a main body forming a bore extending a length of the main body to a downhole opening, the downhole opening having a diameter less than a diameter of the conversion ball, and one or more circulation ports extending through a thickness of the main body, wherein the one or more circulation ports create an associated maximum flowrate of an associated one of the plurality of interchangeable ball cages such that a first of the plurality of interchangeable ball cages has a first maximum flowrate that differs from a second maximum flowrate of a second of the plurality of interchangeable ball cages;

selecting one of the plurality of interchangeable ball cages based on the associated maximum flowrate;

attaching the selected one of the plurality of interchangeable ball cages to the autofill tube to complete the autofill conversion assembly;

launching the autofill conversion assembly with a casing; and using the autofill conversion assembly for one or more well operations, wherein the conversion ball is released from the ball cage to travel to the downhole opening of the interchangeable ball cage, the conversion ball blocking the downhole opening from fluid flow while not blocking the one or more circulation ports from fluid flow.

14. The method of claim 13, wherein the attaching the selected one of the plurality of interchangeable ball cages to the autofill tube is completed at a well site.

15. The method of claim 13, wherein the attaching the selected one of the plurality of interchangeable ball cages to the autofill tube is completed through a threaded connection between the selected one of the plurality of interchangeable ball cages and the autofill tube.

* * * * *